US011400346B2

(12) United States Patent
Sato

(10) Patent No.: US 11,400,346 B2
(45) Date of Patent: Aug. 2, 2022

(54) BALANCE TRAINING APPARATUS AND CONTROL PROGRAM FOR BALANCE TRAINING APPARATUS

(71) Applicant: Toyota Jidosha Kabushiki Kaisha, Toyota (JP)

(72) Inventor: Yoh Sato, Miyoshi (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 348 days.

(21) Appl. No.: 16/810,175

(22) Filed: Mar. 5, 2020

(65) Prior Publication Data

US 2020/0289895 A1 Sep. 17, 2020

(30) Foreign Application Priority Data

Mar. 15, 2019 (JP) ..... JP2019-047883

(51) Int. Cl.
*A63B 24/00* (2006.01)
*A63B 26/00* (2006.01)
*A63B 22/00* (2006.01)

(52) U.S. Cl.
CPC ..... *A63B 26/003* (2013.01); *A63B 24/0062* (2013.01); *A63B 2022/0094* (2013.01); *A63B 2208/0204* (2013.01); *A63B 2230/01* (2013.01)

(58) Field of Classification Search
CPC ..... A63B 26/003; A63B 24/0062; A63B 2022/0094; A63B 2208/0204; A63B 2230/01; A63B 22/20; A63B 71/0054; A63B 24/0087; A63B 24/0059; A63B 71/0622; A63B 71/0669; A63B 2024/0093; A63B 2071/025; A63B 2071/0647; A63B 2071/0675; A63B 2071/0683; A63B 71/0009; A63B 2024/0096;
(Continued)

(56) References Cited

U.S. PATENT DOCUMENTS 9,149,222 B1 * 10/2015 Zets ..... A61B 5/4023
9,526,946 B1 * 12/2016 Zets ..... A61B 5/4023
(Continued)

FOREIGN PATENT DOCUMENTS

CN 106530879 A 3/2017
JP 2004-138547 A 5/2004
(Continued)

*Primary Examiner* — Sundhara M Ganesan
(74) *Attorney, Agent, or Firm* — Dinsmore & Shohl LLP

(57) ABSTRACT

A balance training apparatus that allows a training person having a disease in his/her balance function to perform appropriate rehabilitation training safely in order to recover the balance function is provided. The balance training apparatus includes a moving carriage configured to be able to move on a moving surface by driving a driving unit, a detection unit configured to detect a load received from training person's feet standing on the moving carriage, a calculation unit configured to calculate a load's center of gravity of the training person's feet on a boarding surface from the load detected by the detection unit, and a control unit configured to convert a displacement amount of the load's center of gravity into a control amount using a setting selected from a plurality of settings, and drive the driving unit based on the control amount to control movement of the moving carriage.

8 Claims, 10 Drawing Sheets

(58) Field of Classification Search
CPC ..... A63B 2071/0638; A63B 2220/10; A63B 2220/20; A63B 2220/30; A63B 2220/52; A63B 2220/54; A63B 2220/80; A63B 2220/833; A63B 22/00
See application file for complete search history.

(56) References Cited

U.S. PATENT DOCUMENTS

| | | | | |
|---|---|---|---|---|
| 10,117,602 | B1 * | 11/2018 | Berme | A61B 5/1128 |
| 2009/0240172 | A1 * | 9/2009 | Fernandez Tournier | A63B 26/003 600/595 |
| 2011/0312473 | A1 * | 12/2011 | Chu | A63B 22/0292 482/54 |
| 2012/0094814 | A1 * | 4/2012 | Atkins | A61B 5/1036 482/142 |
| 2015/0328497 | A1 * | 11/2015 | Doucot | A63B 24/0062 482/146 |
| 2015/0343266 | A1 * | 12/2015 | Vardy | A63B 26/003 482/8 |
| 2016/0228746 | A1 * | 8/2016 | Jayakumar | A63B 71/0054 |
| 2016/0346156 | A1 * | 12/2016 | Walsh | A61H 3/008 |
| 2017/0072266 | A1 | 3/2017 | Sasaki et al. | |
| 2017/0189259 | A1 * | 7/2017 | Song | A61F 4/00 |
| 2018/0289579 | A1 * | 10/2018 | Agrawal | A61B 5/112 |

FOREIGN PATENT DOCUMENTS

| | | | |
|---|---|---|---|
| JP | 2007-124866 | A | 5/2007 |
| JP | 2015-100477 | A | 6/2015 |
| JP | 2018-121911 | A | 8/2018 |

* cited by examiner

BALANCE TRAINING APPARATUS AND CONTROL PROGRAM FOR BALANCE TRAINING APPARATUS

CROSS REFERENCE TO RELATED APPLICATIONS

This application is based upon and claims the benefit of priority from Japanese patent application No. 2019-047883, filed on Mar. 15, 2019, the disclosure of which is incorporated herein in its entirety by reference.

BACKGROUND

The present disclosure relates to a balance training apparatus and a control program for the balance training apparatus.

A training apparatus for a patient with a disability in his/her leg to perform rehabilitation training is becoming widespread. For example, a training apparatus that moves a footboard with driving means in order to make a training person who performs training stand on the footboard and observe a center of gravity position, and to encourage the training person to take a step or prevent the training person from falling is known (for example, see Japanese Unexamined Patent Application Publication No. 2015-100477).

SUMMARY

In a configuration in which a footboard moves by a small amount relative to the training apparatus, the training person basically maintains a state in which he/she stands upright with respect to a floor surface, which makes it difficult to maintain the training person's motivation due to poor changes in environment during training. When game characteristics are given to a training attempt, the greater the bodily sensation achieved in association with a game, the greater the training person is motivated to take part in the training attempt. It has been found that a configuration in which a moving carriage is provided in a balance training apparatus and the entire balance training apparatus moves while a training person is on board is effective for rehabilitation training. However, it may sometimes be difficult for some of the training persons to maintain a state in which the training person is standing on a boarding surface, because stimulus given to the training person by the movement of the moving carriage in such a balance training apparatus can be set as appropriate, for example, in association with the game. On the other hand, the greater the stimulus, the more fun the rehabilitation training becomes.

The present disclosure has been made to solve such a problem. An object of the present disclosure is to provide a balance training apparatus and the like that allow a training person having a disease in his/her balance function to perform appropriate rehabilitation training safely in order to recover the balance function.

A first example aspect is a balance training apparatus including: a moving carriage configured to be able to move on a moving surface by driving a driving unit; a detection unit configured to detect a load received from training person's feet standing on the moving carriage; a calculation unit configured to calculate a load's center of gravity of the training person's feet on a boarding surface from the load detected by the detection unit; and a control unit configured to convert a displacement amount of the load's center of gravity into a control amount using a setting selected from a plurality of settings, and drive the driving unit based on the control amount to control movement of the moving carriage. When the control amount is determined according to the displacement amount of the load's center of gravity from among a plurality of settings in this manner, it is possible to give stimulus suitable for the training person within a safe range.

Further, in the above balance training apparatus, each of the plurality of settings may be prepared in advance corresponding to a training stage, and a setting used for the conversion may be selected according to the training stage of the training person. With such a configuration, for example, when a training attempt is performed in a game format, the stimulus given by the moving carriage can be changed according to the level of the task game. That is, the training person can enjoy appropriate stimulus according to his/her training stage.

In the above balance training apparatus, each of the plurality of settings is configured in such a way that a displacement amount of the control amount per unit displacement amount becomes greater when the displacement of the load's center of gravity is greater than or equal to a threshold than the displacement amount of the control amount per unit displacement amount when the displacement amount of the load's center of gravity is less than the threshold. With such a setting, even when the training person moves his/her center of gravity back and forth near the reference position, the moving carriage will not shake greatly. Further, when the training person moves his/her center of gravity by a small amount, the moving carriage also moves slowly, while when the training person moves his/her center of gravity by a large amount, the moving carriage also moves largely. By doing so, it can be expected that the movement of the moving carriage matches the sense of the training person well.

Further, in the above balance training apparatus, the control unit may be configured to convert the displacement amount into a target speed using the selected setting, and calculate the control amount for causing the moving carriage to reach the target speed. Alternatively, the control unit may be configured to convert the displacement amount into a target position using the selected setting, and calculate the control amount for causing the moving carriage to reach the target position. In this way, when the displacement amount of the load's center of gravity is converted into the control amount, if conversion is performed based on the speed control or based on the position control, it is possible to perform control with emphasis on a feeling of acceleration given to the training person or perform control according to a size of a facility. Furthermore, in the balance training apparatus, the moving carriage is able to move in a straight direction by the driving of the driving unit, and the control unit may be configured to convert the displacement amount along the straight direction of the load's center of gravity into the control amount. Thus, when the moving carriage is moved according to the displacement amount of the load's center of gravity along a moving direction, a feeling of operation of the training person improves.

A second example aspect is a control program for a balance training apparatus for performing balance training by a training person standing on a moving carriage moving on a moving surface by driving a driving unit. The control program causes a computer to execute detecting a load received from training person's feet standing on the moving carriage, calculating a load's center of gravity of the training person's feet on a boarding surface from the load detected in the detecting, converting a displacement amount of the load's center of gravity into a control amount using a setting selected from a plurality of settings, and driving the driving unit based on the control amount to control movement of the moving carriage. With the balance training apparatus controlled by such a control program, it is possible to give stimulus suitable for the training person within a safe range, as discussed above.

According to the present disclosure, it is possible to provide a balance training apparatus and the like that allow a training person having a disease in his/her balance function to perform appropriate rehabilitation training safely in order to recover the balance function.

The above and other objects, features and advantages of the present disclosure will become more fully understood from the detailed description given hereinbelow and the accompanying drawings which are given by way of illustration only, and thus are not to be considered as limiting the present disclosure.

DETAILED DESCRIPTION

Hereinafter, the present disclosure will be described through embodiments of the disclosure, but the disclosure according to the claims is not limited to the following embodiments. Further, all of the configurations described in the embodiments are not necessarily essential as means for solving the problem.

Figure 1:
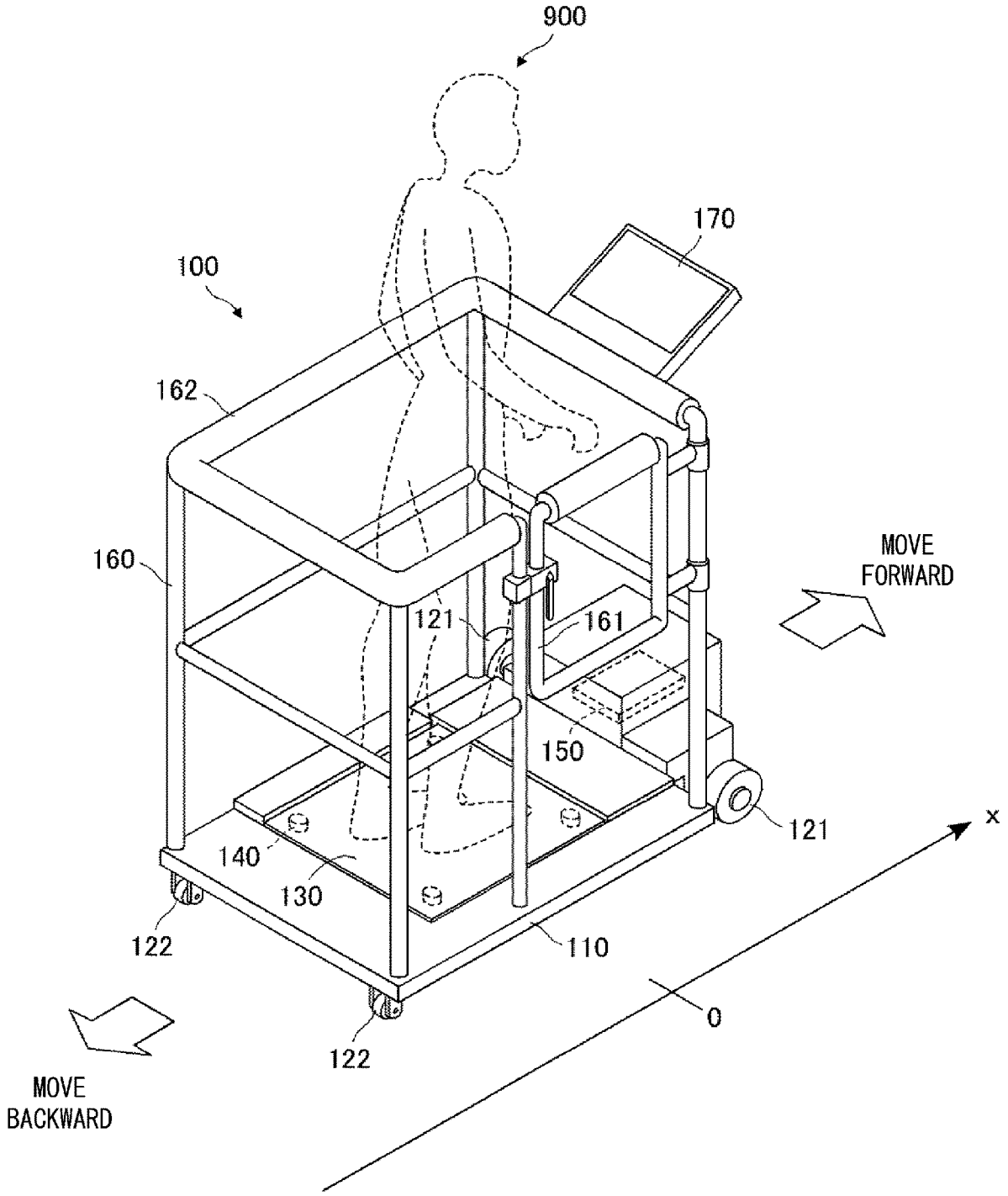
FIG. 1 is a schematic perspective view of a balance training apparatus according to an embodiment.

FIG. 1 is a schematic perspective view of a training apparatus 100 as an example of a balance training apparatus according to this embodiment. The training apparatus 100 is an apparatus for a disabled person with a disability such as hemiplegia to learn to shift his/her center of gravity which is necessary for walking, or for a patient with a disability in his/her ankle joint to recover the ankle joint function. For example, when a training person 900 who wants to recover the ankle joint function tries to continue boarding the training apparatus 100 while maintaining his/her balance, the training apparatus 100 can apply a load that can expect a rehabilitation effect to the training person 900's ankle joint.

The training apparatus 100 includes a moving carriage 110 and a frame 160. The moving carriage 110 is able to move in a front-rear direction on a moving surface that is a floor surface or the like of a rehabilitation facility. The frame 160 is provided to stand on the moving carriage 110 and prevents the training person 900 boarding the moving carriage 110 from falling. The moving carriage 110 mainly includes driving wheels 121, casters 122, a boarding plate 130, load sensors 140, and a control box 150.

The driving wheels 121 are arranged as two front wheels with respect to a traveling direction. Each driving wheel 121 is rotationally driven by a motor (not shown) as a driving unit, and moves the moving carriage 110 forward or backward. The front-rear direction in which the moving carriage 110 is moved is defined as an x-axis, a reference position where the training apparatus 100 is installed in an initial state is defined as an origin (x=0), a forward direction is defined as a positive direction, and a backward direction is defined as a negative direction. The casters 122 are driven wheels and are arranged as two rear wheels with respect to the traveling direction. The boarding plate 130 is a boarding unit on which the training person 900 boards and places his/her feet. A flat plate made of, for example, a polycarbonate resin with a relatively high rigidity that can withstand the boarding of the training person 900 is used as the boarding plate 130. The boarding plate 130 is supported on an upper surface of the moving carriage 110 with the load sensors 140 disposed at four corners interposed therebetween.

Each of the load sensors 140 is, for example, a load cell, and functions as a detection unit that detects a load received from the training person 900's feet standing on the moving carriage 110. The control box 150 accommodates an arithmetic processing unit and a memory, which will be described later.

The frame 160 includes an opening and closing door 161 and a handrail 162. The opening and closing door 161 is opened when the training person 900 boards the boarding plate 130 to form a passage for the training person 900. The opening and closing door 161 is closed and locked when the training person 900 performs a training attempt. The handrail 162 is provided to surround the training person 900 so that it can be grasped when the training person 900 is about to lose his/her balance or feels uneasy. Note that when the training person 900 performs a training attempt, he/she tries to maintain an upright posture by maintaining his/her balance by himself/herself without grasping the handrail 162. The frame 160 supports a display panel 170. The display panel 170 is a display unit that is, for example, a liquid crystal panel. The display panel 170 is disposed at a position where the training person 900 can easily see during the training attempt.

Figure 2:
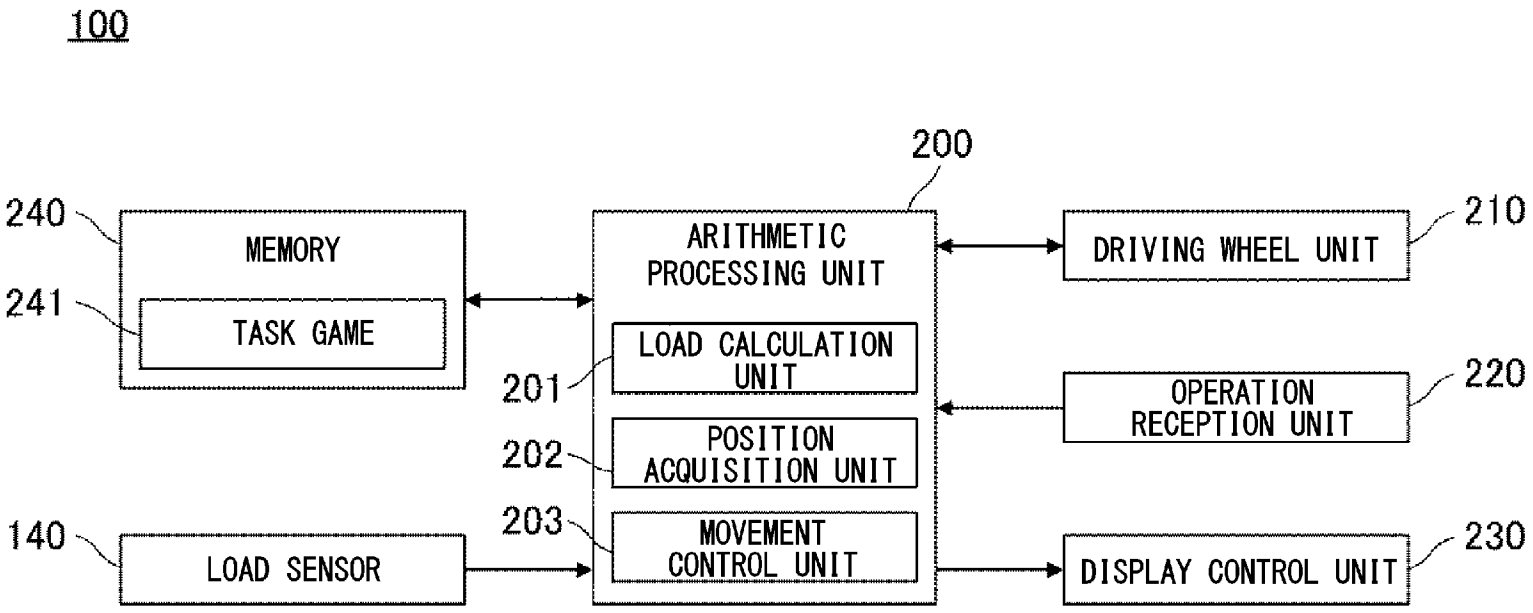
FIG. 2 shows a system configuration of the balance training apparatus.

FIG. 2 shows a system configuration of the training apparatus 100. An arithmetic processing unit 200 is, for example, an MPU and performs control of the entire apparatus by executing a control program read from a memory 240. A driving wheel unit 210 includes a driving circuit and a motor for driving the driving wheels 121. The driving wheel unit 210 includes a rotary encoder that detects an amount of rotation of the driving wheels 121.

An operation reception unit 220 receives input operations from the training person 900 and an operator, and transmits an operation signal to the arithmetic processing unit 200. The training person 900 or the operator operates an operation button provided on the apparatus, a touch panel superimposed on the display panel 170, an attached remote controller, or the like, which constitute the operation reception unit 220, in order to give an instruction for turning on and off the power and for starting a training attempt, to enter numerical values for setting, and to select menu items.

A display control unit 230 generates a graphic video image and the like of a task game, which will be described later, in accordance with a display signal from the arithmetic processing unit 200, and displays the graphic video image and the like on the display panel 170. The memory 240 is a non-volatile storage medium. For example, a solid state drive is used as the memory 240. The memory 240 stores a control program and so on for controlling the training apparatus 100. The memory 240 further stores various parameter values, functions, lookup tables and so on used for control. In particular, the memory 240 stores a task game 241 that is a program for giving a task in a game format so that the training person 900 can enjoy a training attempt. The load sensors 140 detect loads applied from the training person 900's feet via the boarding plate 130, and transmit detection signals to the arithmetic processing unit 200.

The arithmetic processing unit 200 also serves as a function execution unit that performs various calculations and control of individual elements in accordance with a request of the control program. A load calculation unit 201 acquires the detection signals of the four load sensors 140 and calculates a load's center of gravity of the training person 900's feet on the boarding surface. Specifically, since the respective positions of the four load sensors 140 are known, the center of gravity position is calculated from the distribution of the loads in the vertical direction detected by the respective load sensors 140, and the center of gravity position is used as the load's center of gravity. The load's center of gravity is calculated as the center of gravity position of a load distribution in this way, and thus the load's center of gravity can also be regarded as a center of foot pressure applied to the boarding surface by the training person 900's feet.

A position acquisition unit 202 acquires the current position of the moving carriage 110 using an output signal of a rotary encoder included in the driving wheel unit 210 and other sensor signals. For example, the position of the moving carriage 110 at the time of starting a training attempt is defined as an origin, and the acquired output signal of the rotary encoder is integrated to calculate a movement amount from the origin as the current position. A movement control unit 203 generates a driving signal to be transmitted to the driving wheel unit 210, and controls the movement of the moving carriage 110 via the driving wheel unit 210. Details of the control method will be described later.

The arithmetic processing unit 200 may be composed of one or more processors. The load calculation unit 201, the position acquisition unit 202, and the movement control unit 203 may be composed of one or more processors. Alternatively, the load calculation unit 201, the position acquisition unit 202, the movement control unit 203, and the display control unit 230 may be composed of one or more processors.

Figure 3:
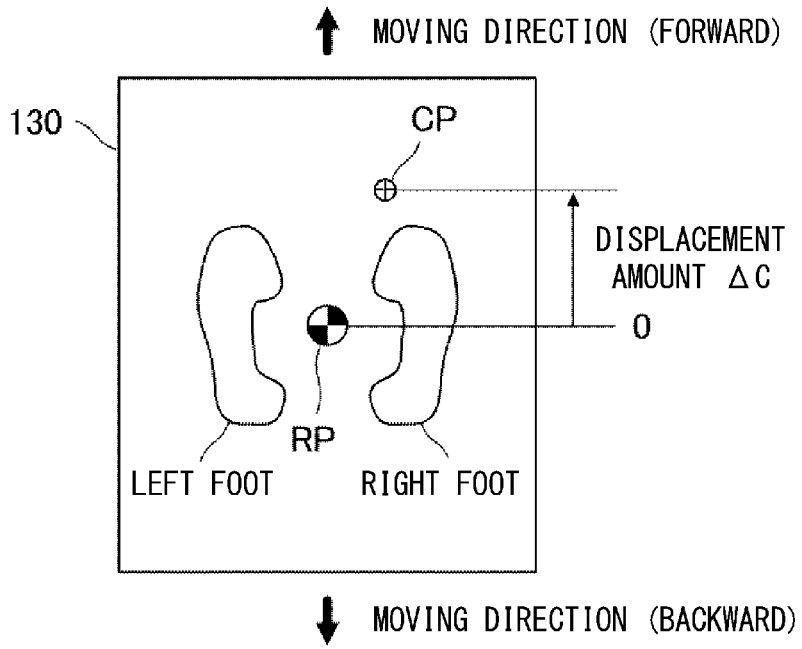
FIG. 3 shows a relationship between a displacement amount of a load's center of gravity and movement of a moving carriage.

FIG. 3 is a diagram for explaining a relationship between a displacement amount ΔC of a load's center of gravity CP and the movement of the moving carriage 110. At the time of starting a training attempt, the training person 900 stands on the boarding surface with a natural as possible standing posture so that the reference position RP determined with respect to the boarding surface of the boarding plate 130 is positioned at a midpoint between the feet. After that, the training person 900 shifts his/her center of gravity according to the progress of the training attempt, and displaces the load's center of gravity CP from the reference position RP by adjusting his/her balance. In this embodiment, since the moving direction of the moving carriage 110 is the front-rear direction, the component along the moving direction of the load's center of gravity CP that is displaced two-dimensionally is defined as a displacement amount ΔC.

In this embodiment, the training person 900 is encouraged to perform training by carrying out the task game 241. The task game 241 processed by the arithmetic processing unit 200 generates a graphic video image that changes every moment and displays the graphic video image on the display panel 170, and the training person 900 is encouraged to perform a moving operation of the training apparatus 100.

Figure 4A:
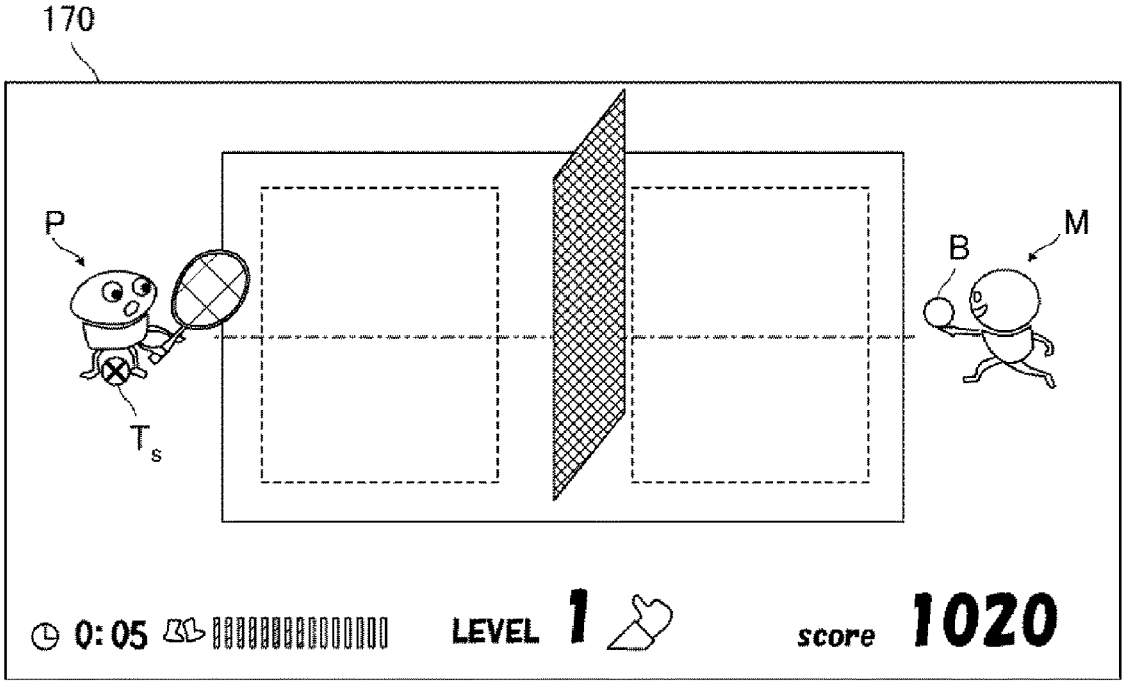
FIG. 4A shows a game screen at the time of starting a training attempt.
Figure 4B:
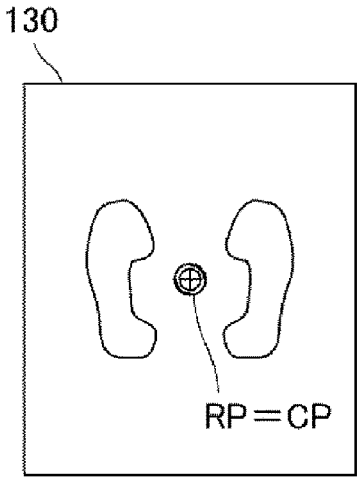
FIG. 4B shows a load's center of gravity of a training person.

FIG. 4A shows a game screen at the time of starting a training attempt, and FIG. 4B shows a load's center of gravity of the training person 900 at that time. The game screen is a video image displayed on the display panel 170, and shows that a game with a tennis concept is selected from among a plurality of task games 241 and then carried out.

On the right side of the tennis court displayed at the center of the screen, a character M throwing a tennis ball B is superimposed on a background image, and on the left side of the tennis court, a character P hitting the thrown tennis ball B back is superimposed on the background image. The character M expresses an action of moving up and down or throwing according to the task given by the task game 241. The character P is a character representing the training person 900 and expresses an action of moving up and down in accordance with the movement of the training apparatus 100 or swinging a racket in accordance with an arrival of the tennis ball B. The tennis ball B reciprocates in the left and right direction on the tennis court in accordance with the actions of the characters M and P. The game screen also includes information such as a score and elapsed time, etc. that change according to a status of the game.

As shown in FIG. 4A, at the time of starting the training attempt, the character P is positioned at an initial position $T_s$ that is the middle in the up and down direction. The character M is also positioned on the opposite side of the initial position $T_s$ with the tennis court interposed therebetween. At this time, it is desirable that the load's center of gravity CP of the training person 900 overlaps with the reference position RP as shown in FIG. 4B. That is, as a preparation for starting a training attempt, the training person 900 stands with a natural as possible standing posture in such a way that the midpoint between the training person 900's feet is positioned at the reference position RP defined for the boarding surface of the boarding plate 130.

Figure 5A:
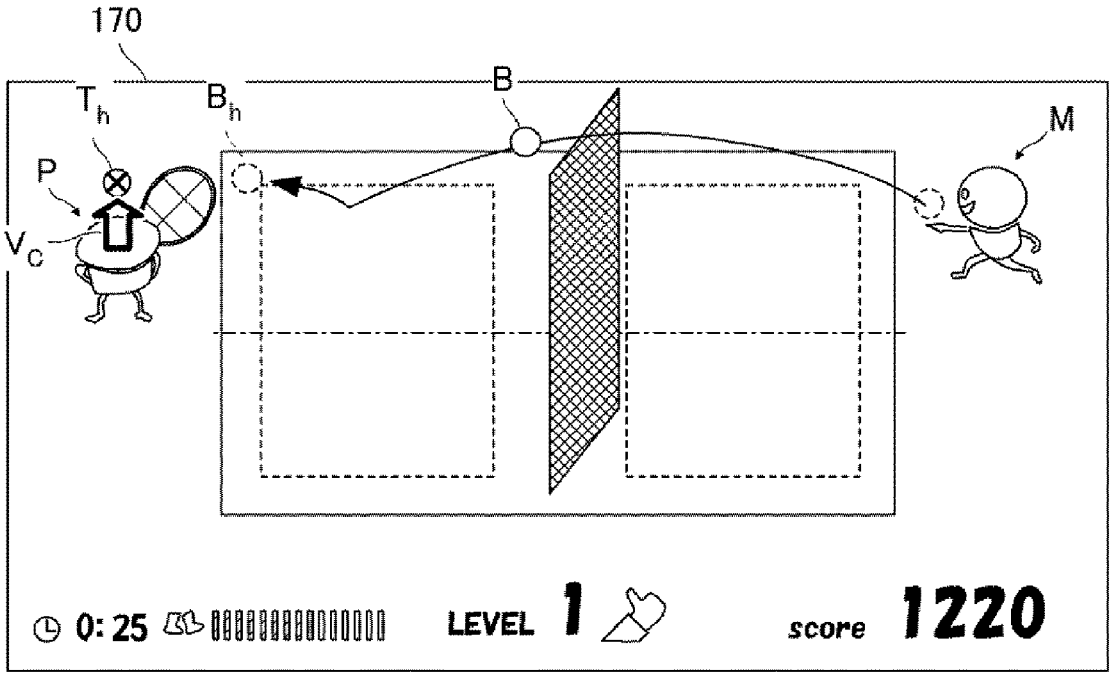
FIG. 5A shows a game screen during a training attempt.
Figure 5B:
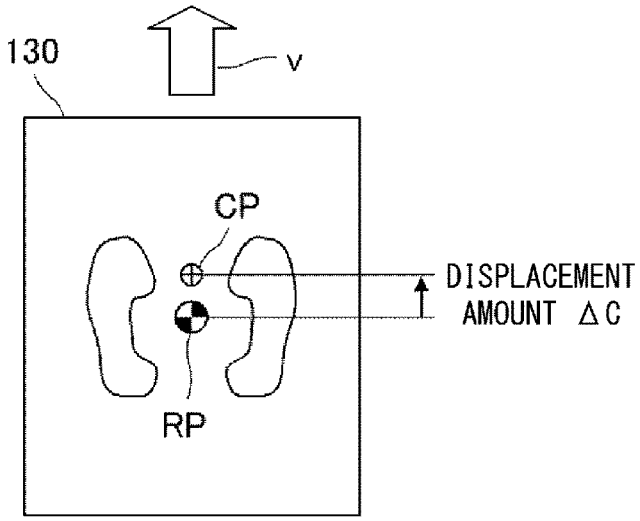
FIG. 5B shows a load's center of gravity of a training person.

FIG. 5A shows a game screen during the training attempt, and FIG. 5B shows the load's center of gravity of the training person 900 at that time. The character M moves to the upper part of the court and throws the tennis ball B so that the tennis ball B can reach a target position $B_h$ set for this task. Then, the tennis ball B moves along the locus shown in the drawing. The speed at which the tennis ball B moves is predetermined according to the level, and is faster as the level becomes higher.

The training person 900 moves the character P to a hitting position $T_h$ where he/she can hit the tennis ball B back at $B_h$ before the tennis ball B reaches $B_h$. That is, as shown in FIG. 5B, the training person 900 moves the load's center of gravity CP forward from the reference position RP by bringing the training person 900's center of gravity forward to adjust his/her balance. The movement control unit 203 drives the driving wheels 121 according to a control amount calculated based on the displacement amount ΔC of the load's center of gravity at this time and moves the moving carriage 110 forward.

The character P on the game screen moves to the upper part of the screen at a speed $V_c$ linked with the speed V of the moving carriage 110 at that time. When the character P can be moved to $T_h$ before the tennis ball B reaches $B_h$, the racket is shaken when the tennis ball B reaches $B_h$ and the tennis ball B is hit back. When the tennis ball B can be hit back, the score is incremented.

Figure 6A:
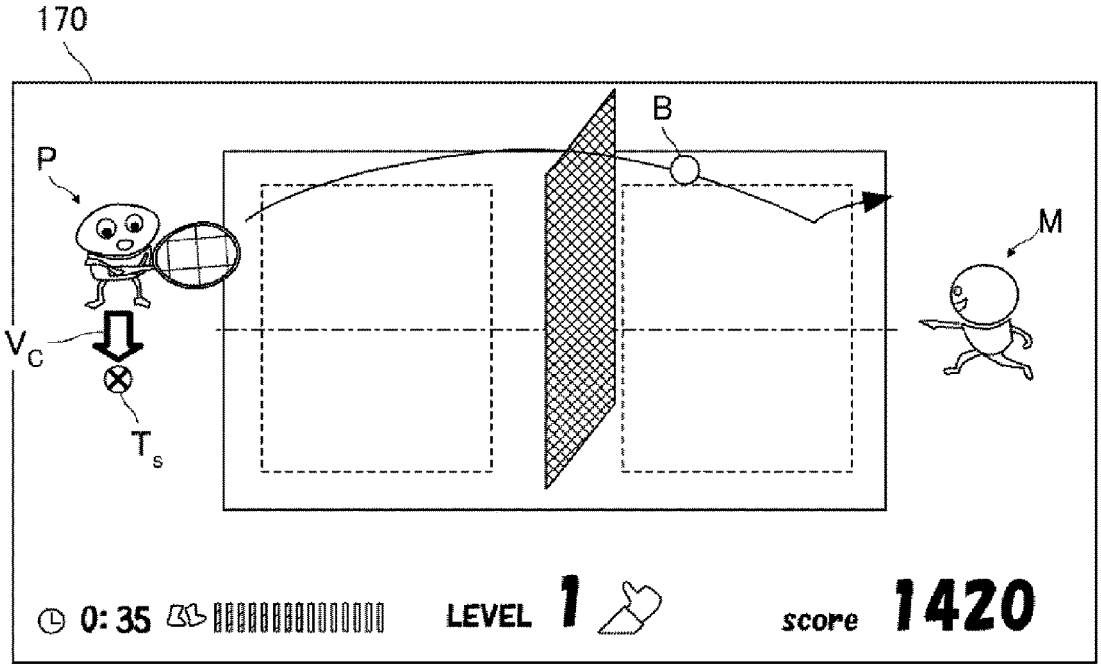
FIG. 6A shows a game screen during a training attempt.
Figure 6B:
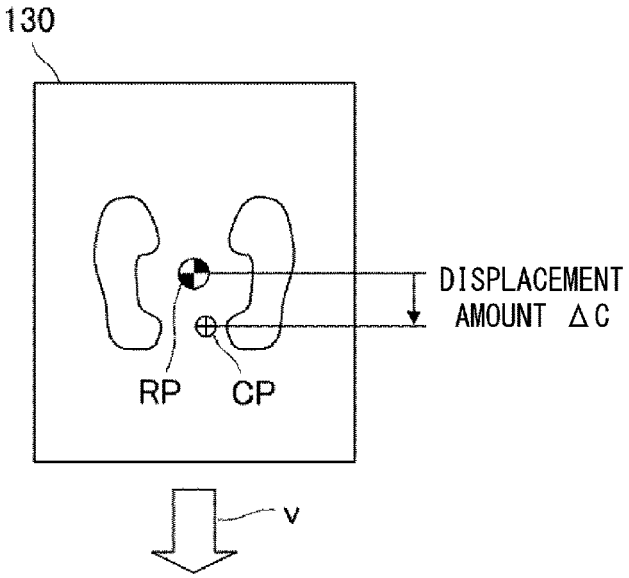
FIG. 6B shows a load's center of gravity of a training person.

FIG. 6A shows a game screen after the training attempt, and FIG. 6B shows the load's center of gravity of the training person 900 at that time. When the character P hits the tennis ball B back, the training person 900 shifts the load's center of gravity CP to behind the reference position RP by shifting the training person's center of gravity backward to adjust his/her balance. The movement control unit 203 drives the driving wheels 121 according to the control amount calculated based on the displacement amount ΔC of the load's center of gravity at this time and moves the moving carriage 110 backward.

The character P on the game screen moves to the lower part of the screen at the speed $V_c$ linked with the speed v of the moving carriage 110. When the character P can be returned to the initial position $T_s$ within a predetermined time, the score is incremented.

A certain amount of time is required until the character P reaches the hitting position $T_h$ or returns to the initial position $T_s$, although it depends on the speed $V_c$ of the character P. During this time, the training person 900 continues to adjust his/her balance by tilting his/her center of gravity. This balance adjustment is effective rehabilitation training for the training person 900 with a disease in the balance function. Further, since the load's center of gravity CP can be changed every moment according to the balance adjustment of the training person 900, the speed v of the moving carriage 110 and the speed $V_c$ of the character P can also change. The training person 900 not only moves the character P according to his/her balance adjustment but also moves the training apparatus 100 itself, so that the training person 900 can obtain sensations that act on his/her sense of balance and sense of posture in addition to visual information, and thus the training person 900 can enjoy the training attempt. When the training person 900 can enjoy the training attempt, it can be expected that the training person 900 can actively and continuously perform training. That is, the balance function can be recovered in a shorter period.

Figure 7:
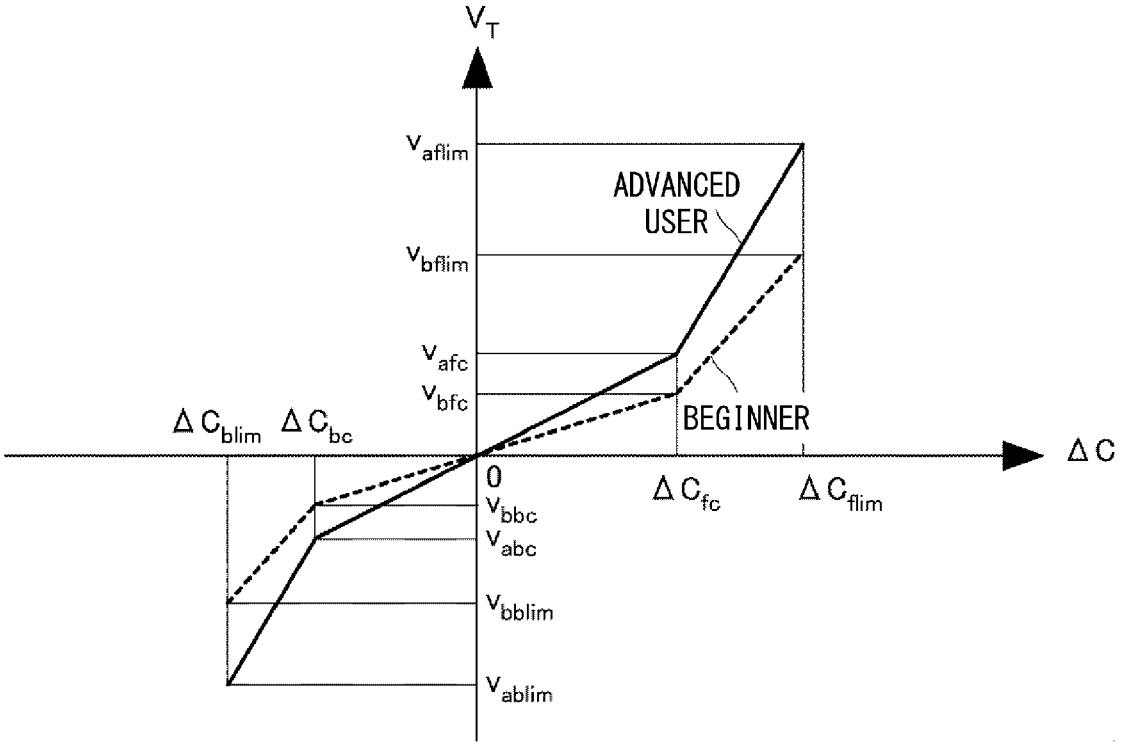
FIG. 7 shows a relationship between a displacement amount and a target speed when speed control is performed.

First, a case in which the movement control unit 203 controls the moving carriage 110 using speed control will be described. FIG. 7 is a diagram showing the relationship between the displacement amount ΔC of the load's center of gravity and a target speed $V_T$ of the moving carriage 110 when the speed control is performed. The horizontal axis represents the displacement amount ΔC of the load's center of gravity, while the vertical axis represents the target speed $V_T$.

A displacement amount $\Delta C_{flim}$ is a limit displacement amount when the training person 900 tilts his/her center of gravity forward without changing his/her step, and a displacement amount $\Delta C_{blim}$ is a limit displacement amount when the training person 900 tilts his/her center of gravity backward without changing his/her step. For example, the displacement amount $\Delta C_{flim}$ is acquired from a result of a measurement in which the training person 900's center of gravity is tilted forward until right before his/her heels are lifted in the air while the training person 900 maintains a standing posture. The displacement amount $\Delta C_{blim}$ is acquired from a result of a measurement in which the training person 900's center of gravity is tilted backward until right before his/her toes are lifted in the air while the training person 900 maintains a standing posture. Alternatively, the movement control unit 203 may select the displacement amounts $\Delta C_{flim}$ and $\Delta C_{blim}$, from a preset lookup table, corresponding to the training person 900's height, weight, foot size, a progress of rehabilitation training, etc. and set the displacement amounts $\Delta C_{flim}$ and $\Delta C_{blim}$.

In the speed control according to this embodiment, a $\Delta C$-$V_T$ conversion formula for advanced users as indicated by the solid line and a $\Delta C$-$V_T$ conversion formula for beginners as indicated by the dotted line are prepared. In the $\Delta C$-$V_T$ conversion formula for the advanced users, when the displacement amount ΔC is in the range of $\Delta C_{bc}$ to $\Delta C_{fc}$ including the reference position RP (ΔC=0), the displacement amount ΔC is proportional to the target speed $V_T$ with a slope $\alpha_{a1}$ (>0), and when $\Delta C=\Delta C_{fc}$, $V_T=v_{afc}$, and when $\Delta C=\Delta C_{bc}$, $V_T=v_{abc}$. Further, when the displacement amount ΔC is in the range of $\Delta C_{blim}$ to $\Delta C_{bc}$ or in the range of $\Delta C_{fc}$ to $\Delta C_{flim}$, the displacement amount ΔC is proportional to the target speed $V_T$ with a slope $\alpha_{a2}$ ($>\alpha_{a1}$), and when $\Delta C=\Delta C_{blim}$, $V_T=v_{ablim}$, and when $\Delta C=\Delta C_{flim}$, $V_T=v_{aflim}$.

$\Delta C_{fc}$ is set, for example, as $\Delta C_{fc}=0.6\times\Delta C_{flim}$, and $\Delta C_{bc}$ is set, for example, as $\Delta C_{bc}=0.6\times\Delta C_{blim}$. That is, the range of $\Delta C_{bc}$ to $\Delta C_{fc}$ is set to a central range in the vicinity of the reference position RP in the range of $\Delta C_{blim}$ to $\Delta C_{flim}$, which is a range in which the training person 900 can maintain a standing state without lifting his/her feet in the air. In this range, the slope $\alpha_{a1}$ to be converted into the target speed is made smaller than the slope $\alpha_{a2}$ in the range of $\Delta C_{blim}$ to $\Delta C_{bc}$ and in the range of $\Delta C_{fc}$ to $\Delta C_{flim}$. In other words, with $|\Delta C_{bc}|$ and $|\Delta C_{fc}|$ as thresholds, when the magnitude of a displacement amount $|\Delta C|$ is large, an increment of the target speed per unit displacement amount is set to become large. With such a setting, even when the training person 900 moves his/her center of gravity back and forth near the reference position RP, the moving carriage 110 will not shake greatly. Further, when the training person 900 moves his/her center of gravity by a small amount, the moving carriage 110 also moves slowly, while when the training person 900 moves his/her center of gravity by a large amount, the moving carriage 110 also moves rapidly and quickly. By doing so, it can be expected that the movement of the moving carriage 110 matches the sense of the training person 900 well. Note that in this embodiment, the threshold $|\Delta C_{fc}|$ when the moving carriage 110 moves forward and the threshold $|\Delta C_{bc}|$ when the moving carriage 110 backward are made to be different from each other. However, these values can be adjusted according to the training person 900's condition and the like. For example, both thresholds may be the same value, or the threshold value $|\Delta C_{fc}|$ when the moving carriage 110 moves forward may be made smaller than the threshold $|\Delta C_{bc}|$ when the moving carriage 110 moves backward.

In the $\Delta C$-$V_T$ conversion formula for the beginners, when the displacement amount ΔC is in the range of $\Delta C_{bc}$ to $\Delta C_{fc}$ including the reference position RP (ΔC=0), the displacement amount ΔC is proportional to the target speed $V_T$ with a slope $\alpha_{b1}$ (>0), and when $\Delta C=\Delta C_{fc}$, $V_T=v_{bfc}$, and when $\Delta C=\Delta C_{bc}$, $V_T=v_{bbc}$. Further, when the displacement amount ΔC is in the range of $\Delta C_{blim}$ to $\Delta C_{bc}$ or in the range of $\Delta C_{fc}$ to $\Delta C_{flim}$, the displacement amount ΔC is proportional to the target speed $V_T$ with a slope $\alpha_{b2}$ ($>\alpha_{b1}$), and when $\Delta C=\Delta C_{blim}$, $V_T=v_{bblim}$, and when $\Delta C=\Delta C_{flim}$, $V_T=v_{bflim}$.

Also in the $\Delta C$-$V_T$ conversion formula for the beginners, the slope $\alpha_{b1}$ in the range of $\Delta C_{bc}$ to $\Delta C_{fc}$ is made smaller than the slope $\alpha_{b2}$ in the range of $\Delta C_{blim}$ to $\Delta C_{bc}$ and in the range of $\Delta C_{fc}$ to $\Delta C_{flim}$. Further, in the range of $\Delta C_{bc}$ to $\Delta C_{fc}$, the slope $\alpha_{a1}$ for the advanced users is made larger than the slope $\alpha_{b1}$ for the beginners ($\alpha_{a1}>\alpha_{b1}>0$). Likewise, in the range of $\Delta C_{blim}$ to $\Delta C_{bc}$ and in the range of $\Delta C_{fc}$ to $\Delta C_{flim}$, the slope $\alpha_{a2}$ for the advanced users is set larger than the slope $\alpha_{b2}$ for the beginners ($\alpha_{a2}>\alpha_{b2}>0$). That is, the setting for the advanced users moves the moving carriage 110 more intensely than the setting for the beginners. With such a setting, the training person 900 can enjoy stimulus suitable for the training stage. For example, in the above-mentioned task game 241 with a tennis concept, the movement control unit 203 automatically switches from the $\Delta C$-$V_T$ conversion formula for the beginners to the $\Delta C$-$V_T$ conversion formula for the advanced users at a timing when the training person 900 completes a stage and a game level rises to a certain game level. Alternatively, the training apparatus may be configured in such a way that the training person 900 or the operator may select either the setting for the beginners or the setting for the advanced users via the operation reception unit 220 at the time of starting a training attempt.

In this embodiment, both $\Delta C_{fc}$ for the advanced users and $\Delta C_{fc}$ for the beginners are set as $0.6\times\Delta C_{flim}$. However, the definition of $\Delta C_{fc}$ for the advanced users may differ from the definition of $\Delta C_{fc}$ for the beginners. For example, $\Delta C_{fc}$ may be narrower for the advanced users such as $\Delta C_{fc}=0.4\times\Delta C_{flim}$. Likewise, the definition of $\Delta C_{bc}$ for the advanced users may differ from the definition of $\Delta C_{bc}$ for the beginners. When the range of $\Delta C_{bc}$ to $\Delta C_{fc}$ is narrowed, the moving carriage 110 is moved more intensely, and thus more advanced training can be provided to the advanced users.

Figure 8:
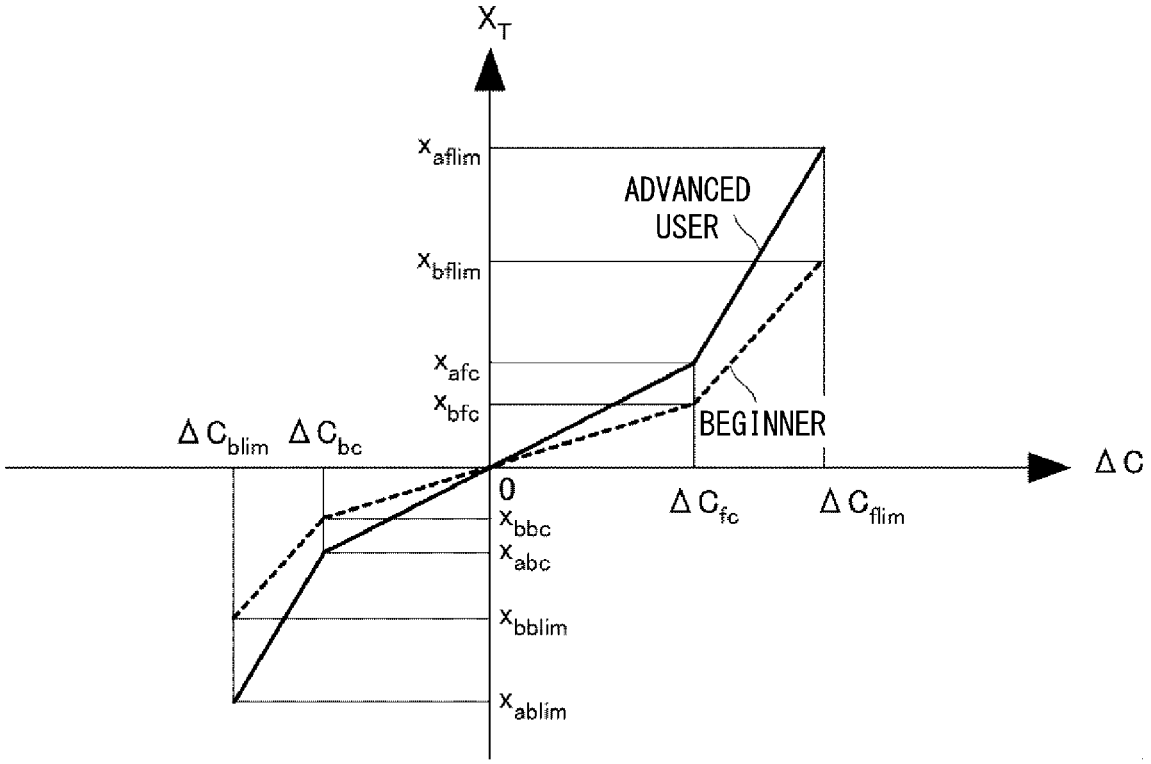
FIG. 8 shows a relationship between a displacement amount and a target position when position control is performed.

Next, a case where the movement control unit 203 controls the moving carriage 110 by using the position control will be described. FIG. 8 shows a relationship between the displacement amount $\Delta C$ of the load's center of gravity and a target position $X_T$ of the moving carriage 110 when the position control is performed. The horizontal axis represents the displacement amount $\Delta C$ of the load's center of gravity, while the vertical axis represents a target position $X_T$.

The displacement amounts $\Delta C_{flim}$, $\Delta C_{blim}$, $\Delta C_{bc}$, $\Delta C_{fc}$ are similar to $\Delta C_{flim}$, $\Delta C_{blim}$, $\Delta C_{bc}$, $\Delta C_{fc}$ in FIG. 7, respectively. In a manner similar to the above-described speed control, in the position control according to this embodiment, the $\Delta C$-$X_T$ conversion formula for the advanced users as indicated by the solid line and the $\Delta C$-$X_T$ conversion formula for the beginners as indicated by the dotted line are prepared. In the $\Delta C$-$X_T$ conversion formula for the advanced users, when the displacement amount $\Delta C$ is in the range of $\Delta C_{bc}$ to $\Delta C_{fc}$ including the reference position RP ($\Delta C=0$), the displacement amount $\Delta C$ is proportional to the target speed $X_T$ with a slope $\beta_{a1}$ (>0) and when $\Delta C=\alpha C_{fc}$, $X_T=X_{afc}$, and when $\Delta C=\Delta C_{bc}$, $X_T=X_{abc}$. Further, when the displacement amount $\Delta C$ is in the range of $\Delta C_{blim}$ to $\Delta C_{bc}$ or in the range of $\Delta C_{fc}$ to $\Delta C_{flim}$, the displacement amount $\Delta C$ is proportional to the target position $X_T$ with a slope $\beta_{a2}$ ($>\beta_{a1}$), and when $\Delta C=\Delta C_{blim}$, $X_T=x_{ablim}$, and when $\Delta C=\Delta C_{flim}$, $X_T=x_{aflim}$.

In the range of $\Delta C_{bc}$ to $\Delta C_{fc}$, the slope $\beta_{a1}$ to be converted into the target position is made smaller than the slope $\beta_{a2}$ in the range of $\Delta C_{blim}$ to $\Delta C_{bc}$ and in the range of $\Delta C_{fc}$ to $\Delta C_{flim}$. In other words, with $\Delta C_{bc}$ and $\Delta C_{fc}$ as thresholds, when the magnitude of a displacement amount $|\Delta C|$ is large, an increment of the target position per unit displacement amount is set to become large. With such a setting, even when the training person 900 moves his/her center of gravity back and forth near the reference position RP, the moving carriage 110 will not shake greatly. Further, when the training person 900 changes his/her center of gravity by a small amount, the moving carriage 110 also moves by a small amount, while when the training person 900 moves his/her center of gravity changes by a large amount, the moving carriage 110 also tries to move farther. Thus, it can be expected that the movement of the moving carriage 110 matches the sense of the training person 900 well.

In the $\Delta C$-$X_T$ conversion formula for the beginners, when the displacement amount $\Delta C$ is in the range of $\Delta C_{bc}$ to $\Delta C_{fc}$ including the reference position RP ($\Delta C=0$), the displacement amount $\Delta C$ is proportional to the target speed $X_T$ with a slope $\beta_{b1}$ (>0) and when $\Delta C=\Delta C_{fc}$, $X_T=x_{bfc}$, and when $\Delta C=\Delta C_{bc}$, $X_T=X_{bbc}$. Further, when the displacement amount $\Delta C$ is in the range of $\Delta C_{blim}$ to $\Delta C_{bc}$ or in the range of $\Delta C_{fc}$ to $\Delta C_{flim}$, the displacement amount $\Delta C$ is proportional to the target speed $X_T$ with a slope $\beta_{b2}$ ($>\beta_{b1}$), and when $\Delta C=\Delta C_{blim}$, $X_T=x_{bblim}$, and when $\Delta C=\Delta C_{flim}$, $X_T=x_{bflim}$.

Also in the $\Delta C$-$X_T$ conversion formula for the beginners, the slope $\beta_{b1}$ in the range of $\Delta C_{bc}$ to $\Delta C_{fc}$ is made smaller than the slope $\beta_{b2}$ in the range of $\Delta C_{blim}$ to $\Delta C_{bc}$ and in the range of $\Delta C_{fc}$ to $\Delta C_{flim}$. Further, in the range of $\Delta C_{bc}$ to $\Delta C_{fc}$, the slope $\beta_{a1}$ for the advanced users is made larger than the slope $\beta_{b1}$ for the beginners ($\beta_{a1}>\beta_{b1}>0$). Likewise, in the range of $\Delta C_{blim}$ to $\Delta C_{bc}$ and in the range of $\Delta C_{fc}$ to $\Delta C_{flim}$, the slope $\beta_{a2}$ for the advanced users is made larger than the slope $\beta_{b2}$ for the beginners ($\beta_{a2}>\beta_{b2}>0$). That is, the moving carriage 110 is moved more intensely with the setting for the advanced users than with the setting for the beginners. With such a setting, the training person 900 can enjoy stimulus suitable for the training stage. For example, in the above-mentioned task game 241 with a tennis concept, the movement control unit 203 automatically switches from the $\Delta C$-$X_T$ conversion formula for the beginners to the $\Delta C$-$X_T$ conversion formula for the advanced users at a timing when the training person 900 completes a stage and a game level rises to a certain game level. Alternatively, the training apparatus may be configured such a way that the training person 900 or the operator may select either the setting for the beginners or the setting for the advanced users via the operation reception unit 220 at the time of starting a training attempt.

Whether the movement control unit 203 performs the speed control or the position control can be associated with each task game 241 in accordance with, for example, the properties of the plurality of prepared task games 241. Alternatively, the training person 900 or the operator may be able to select whether to employ the movement control or the position control via the operation reception unit 220 at time of starting the training attempt. Further, for example, the movement control and the position control may be switched according to the position of the moving carriage 110.

Figure 9:
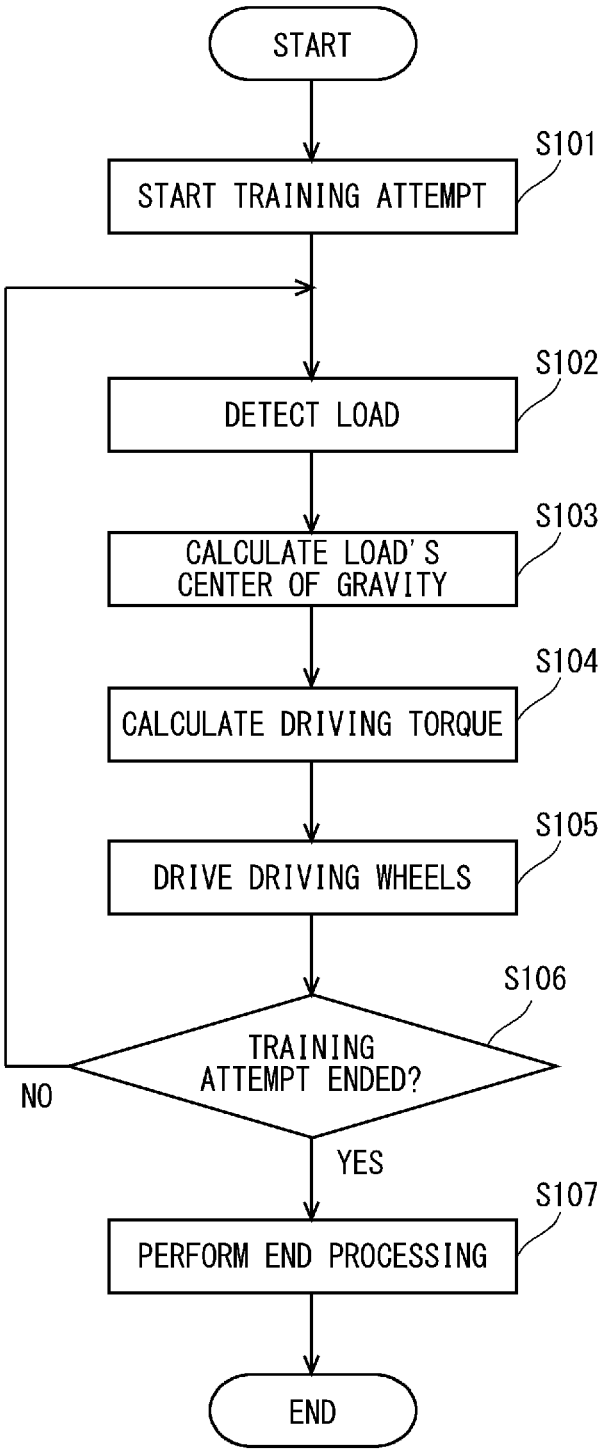
FIG. 9 shows a processing flow of a training attempt.

FIG. 9 is a flowchart showing a processing flow of a training attempt. For example, the flow is started in a state in which the training person 900 has boarded the boarding plate 130. In Step S101, the arithmetic processing unit 200 reads the designated task game 241 from the memory 240, and starts a training attempt through the task game 241. The arithmetic processing unit 200 displays a video image in accordance with the progress of the task game 241 on the display panel 170 via the display control unit 213.

In Step S102, the load sensor 140 detects a load received from the training person 900's feet in accordance with the progress of the task game 241, and passes the detected detection signal to the load calculation unit 201. In Step S103, the load calculation unit 201 calculates the load's center of gravity from the received detection signal, and passes the calculated load's center of gravity to the movement control unit 203.

In Step S104, the movement control unit 203 calculates the displacement amount $\Delta C$ from the received load's center of gravity. Then, the movement control unit 203 confirms whether the current training attempt is set for the advanced users or for the beginners. As described above, the movement control unit 203 uses the conversion formula for the beginners when the setting is for the beginners, and uses the conversion formula for the advanced users when the setting is for the advanced users. The displacement amount ΔC is converted into the target speed $V_T$ or the target position $X_T$.

When the displacement amount ΔC is converted into the target speed $V_T$, a driving torque is calculated as a control amount for causing the moving carriage 110 to reach the target speed $V_T$. Specifically, the movement control unit 203 calculates a current speed v of the moving carriage 110 from an output of the driving wheel unit 210, and calculates the driving torque by, for example, PID control from a difference between the target speed $V_T$ and the current speed v. When the displacement amount ΔC is converted into the target position $X_T$, the movement control unit 203 calculates the driving torque as a control amount for causing the moving carriage 110 to reach the target position $X_T$. Specifically, the movement control unit 203 receives the current position x of the moving carriage 110 from the position acquisition unit 202, and calculates the driving torque by, for example, PID control from the difference between the target position $X_T$ and the current position x. In Step S105, a driving signal for outputting the driving torque is transmitted to the driving wheel unit 210 to drive the driving wheels 121. Furthermore, the arithmetic processing unit 200 moves the character P on the display panel 170 in accordance with the driving of the driving wheels 121, and lets the task game 241 proceed.

In Step S106, the arithmetic processing unit 200 determines whether the training attempt has ended. The training attempt ends, for example, when the task game 241 ends, a set period of time elapses, or a target item is achieved. When the arithmetic processing unit 200 determines that the training attempt has not ended, the process returns to Step S102 where the training attempt is continued, whereas when the arithmetic processing unit 200 determines that the training attempt has ended, the process proceeds to Step S107. In Step S108, the arithmetic processing unit 200 executes end processing to end a series of processing. The end processing is to display the final score on the display panel 170 and update history information of the training that has been carried out so far.

Figure 10:
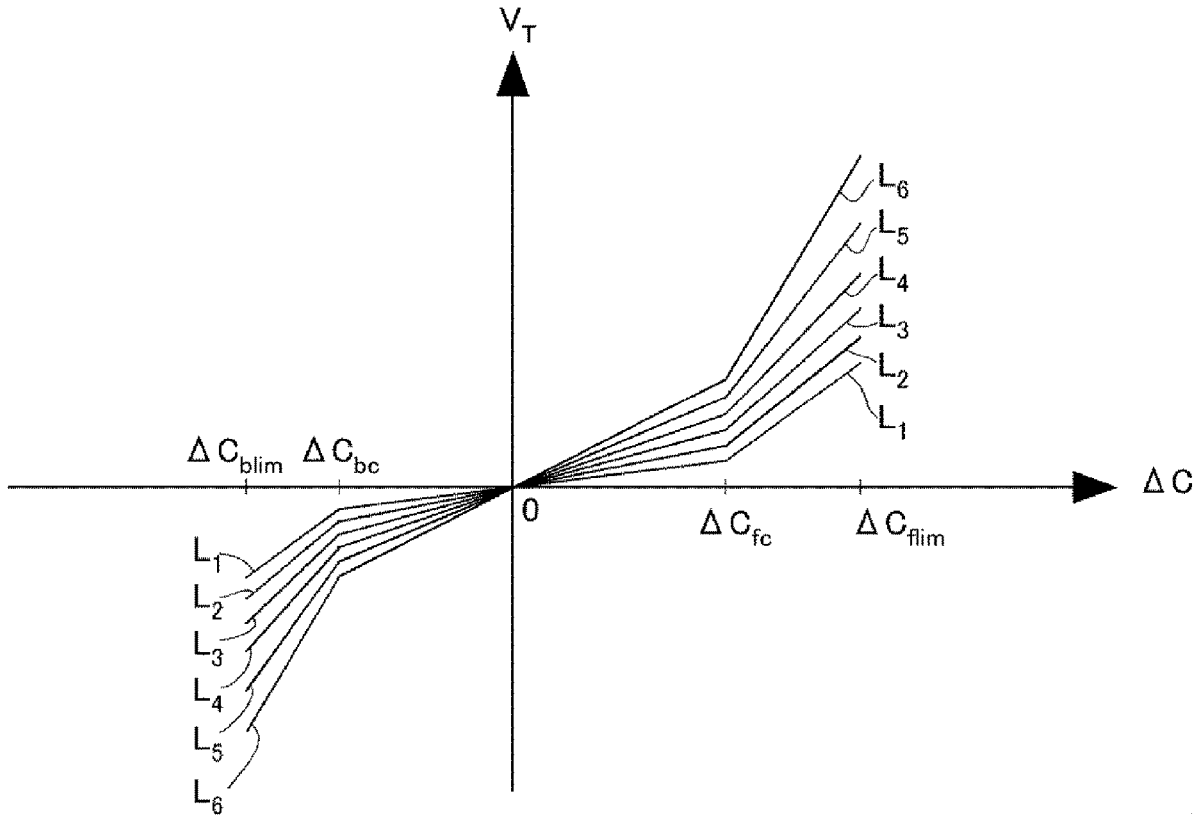
FIG. 10 shows a relationship between a displacement amount and a target speed according to another example.

FIG. 10 shows a relationship between the displacement amount ΔC and the target speed $V_T$ according to another example. In the example of FIG. 7, two ΔC-$V_T$ conversion formulas for advanced users and beginners are prepared. However, as shown in FIG. 10, for example, when the task game 241 provides six levels, six ΔC-$V_T$ conversion formulas $L_1$ to $L_6$ may be associated with the six levels. In this case, the higher the level, the greater the slope α is set to become. For example, when the conversion formula of $L_1$ is 1.0, the gains of $L_2$ to $L_6$ are set as 1.1, 1.2, 1.3, 1.4, and 1.5, respectively, and slopes of $L_2$ to $L_6$ may be calculated by multiplying the slope α of the conversion formula of $L_1$ by the gains corresponding to the respective levels. In a manner similar to the speed control, also in the position control, six ΔC-$X_T$ conversion formulas $L_1$ to $L_6$ may be made to correspond to the respective levels.

In the above-described embodiments, the moving carriage 110 has a structure that moves back and forth, and thus the movement control and task games corresponding to such a structure are employed. However, when the moving carriage 110 has a structure that also moves in the right-left direction, the movement control and task games corresponding to such a structure that moves back and forth and also left and right may be employed. In the above-described embodiments, the movement control is performed by calculating the displacement amount ΔC in the front-rear direction, which is the moving direction of the moving carriage 110. However, when the moving carriage 110 can also move in the right-left direction, the moving direction and the target speed may be determined according to a vector from the reference position RP to the load's center of gravity, and similar movement control can be performed. In this case, a moving area is defined two-dimensionally, and thus weighting of a first control amount and weighting of a second control amount may also be defined two-dimensionally.

In this embodiment described above, the ΔC-$V_T$ conversion formula is used for the speed control, and the ΔC-$X_T$ conversion formula is used for the position control. However, instead of using the conversion formulas, for example, a lookup table may be used to convert the displacement amount ΔC into the target speed $V_T$ or the target position $X_T$. The control is not limited to the speed control and the position control, and other types of control may be employed. In such a case, the displacement amount ΔC may be converted into a control amount corresponding to the control.

The program can be stored and provided to a computer using any type of non-transitory computer readable media. Non-transitory computer readable media include any type of tangible storage media. Examples of non-transitory computer readable media include magnetic storage media (such as floppy disks, magnetic tapes, hard disk drives, etc.), optical magnetic storage media (e.g. magneto-optical disks), CD-ROM (compact disc read only memory), CD-R (compact disc recordable), CD-R/W (compact disc rewritable), and semiconductor memories (such as mask ROM, PROM (programmable ROM), EPROM (erasable PROM), flash ROM, RAM (random access memory), etc.). The program may be provided to a computer using any type of transitory computer readable media. Examples of transitory computer readable media include electric signals, optical signals, and electromagnetic waves. Transitory computer readable media can provide the program to a computer via a wired communication line (e.g. electric wires, and optical fibers) or a wireless communication line.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A balance training apparatus comprising:

a moving carriage configured to be able to move on a moving surface by driving a driving unit;

a detection unit configured to detect a load received from training person's feet standing on the moving carriage;

a calculation unit configured to calculate a load's center of gravity of the training person's feet on a boarding surface from the load detected by the detection unit; and a control unit configured to convert a displacement amount of the load's center of gravity into a control amount using a setting selected from a plurality of settings, and drive the driving unit based on the control amount to control movement of the moving carriage.

2. The balance training apparatus according to claim 1, wherein each of the plurality of settings is prepared in advance corresponding to a training stage, and a setting used for the conversion is selected according to the training stage of the training person.

3. The balance training apparatus according to claim 1, wherein each of the plurality of settings is configured in such a way that a displacement amount of the control amount per unit displacement amount becomes greater when the displacement of the load's center of gravity is greater than or equal to a threshold than the displacement amount of the control amount per unit displacement amount when the displacement amount of the load's center of gravity is less than the threshold.

4. The balance training apparatus according to claim 1, wherein the control unit is configured to convert the displacement amount into a target speed using the selected setting, and calculate the control amount for causing the moving carriage to reach the target speed.

5. The balance training apparatus according to claim 1, wherein the control unit is configured to convert the displacement amount into a target position using the selected setting, and calculate the control amount for causing the moving carriage to reach the target position.

6. The balance training apparatus according to claim 1, wherein the moving carriage is able to move in a straight direction by the driving of the driving unit, and the control unit is configured to convert the displacement amount along the straight direction of the load's center of gravity into the control amount.

7. A balance training apparatus comprising:

a moving carriage configured to be able to move on a moving surface by driving a driving unit;

a sensor configured to detect a load received from training person's feet standing on the moving carriage;

processer configured to calculate a load's center of gravity of the training person's feet on a boarding surface from the load detected by the sensor, and to convert a displacement amount of the load's center of gravity into a control amount using a setting selected from a plurality of settings, and drive the driving unit based on the control amount to control movement of the moving carriage.

8. A non-transitory computer readable medium storing a control program for a balance training apparatus for performing balance training by a training person standing on a moving carriage moving on a moving surface by driving a driving unit, the control program causing a computer to execute:

detecting a load received from training person's feet standing on the moving carriage;

calculating a load's center of gravity of the training person's feet on a boarding surface from the load detected in the detecting;

converting a displacement amount of the load's center of gravity into a control amount using a setting selected from a plurality of settings; and driving the driving unit based on the control amount to control movement of the moving carriage.

* * * * *